United States Patent [19]

Bell, III et al.

[11] 4,105,062

[45] Aug. 8, 1978

[54] TWO-STAGE REGENERATOR SEAL

[75] Inventors: Albert H. Bell, III, Birmingham; Richard M. Zeek, Farmington, both of Mich.

[73] Assignee: General Motors Corporation, Detroit, Mich.

[21] Appl. No.: 796,688

[22] Filed: May 13, 1977

[51] Int. Cl.[2] ..... F28D 19/00

[52] U.S. Cl. ..... 165/9; 277/815; 277/83; 277/88

[58] Field of Search ..... 165/9; 277/81 S, 83, 277/88

[56] References Cited

U.S. PATENT DOCUMENTS 3,368,611 2/1968 Bracken, Jr. et al. ..... 165/9 X 3,542,122 11/1970 Bracken, Jr. ..... 165/9

*Primary Examiner*—Albert W. Davis, Jr.

*Attorney, Agent, or Firm*—J. C. Evans

[57] ABSTRACT

A regenerator seal assembly for use in a rotary regenerator includes a two-stage seal with a peripheral rim seal having a seal leaf turned inside out so that the free end of the leaf is of a smaller radius of curvature than the fixed end of the leaf and wherein the outer peripheral rim seal is made up of a plurality of straight leaf segments formed on chord lines along the outer circumference of the seal assembly with each straight leaf segment being joined by a mitered joint so that the free end of each such leaf segment is deflected without formation of waviness of wrinkles in the seal assembly.

3 Claims, 10 Drawing Figures

TWO-STAGE REGENERATOR SEAL

This invention relates to rotary regenerator seal assemblies and more particularly to seal assemblies for rotary regenerators of the axial flow type having a two-stage seal configuration thereof to reduce wall pressure in cell components of a rotary matrix or disc in the rotary regenerator assembly.

Conventional rotary regenerator systems for use in automotive gas turbine engines and the like typically include a regenerator seal assembly that defines a single stage pressure seal against leakage of high pressure gas from within the rotary regenerator. More particularly, such seal assemblies will include a seal contact region between a seal face of the seal wear surface and the regenerator matrix and additionally a seal interface between a flexible seal member in the form of a leaf or bellows which acts against a plane surface of a housing to bias the seal wear face against the regenerator matrix and to provide flexible sealing as it is rotated with respect to the housing.

U.S. Pat. No. 3,368,611, issued Feb. 13, 1968, to J. W. Bracken, Jr. et al, for Rotary Regenerator Seal With High Pressure Fluid Recovery, sets forth a proposal to reduce leakage rates across such seal assemblies. More particularly, the regenerator seal in the aforesaid Bracken et al patent includes two flexible seal members with matrix contacting seal wear faces at a cross arm segment of the seal assembly to reduce leakage from a high pressure gas side to the seal assembly to a lower pressure region therein by reducing the high pressure gas to an intermediate pressure between the two flexible seal members. In addition, a pressure equalization port is directed through the seal cross arms to communicate a space between flexible sealing leafs or bellows. Such a ported configuration will tend to establish a suitable mid-pressure range in the space between the seal wear faces. The presence of a mid-pressure between the seal wear face and the regenerator core will act to maintain a reduced pressure difference across individual cell walls in the rotary regenerator disc to approximately one-half of that found in prior single stage seal assemblies thereby reducing cell wall stress.

In prior art arrangements such as set forth in the aforesaid Bracken Jr. et al patent it has been found difficult to always maintain a constant mid-pressure condition at the crossarm portion of the illustrated two-stage type regenerator seal assembly. More particularly, in the Bracken Jr. et al arrangement rim seals have either diaphragms with free ends or leaves with free ends at the low pressure opening in the regenerator which are configured so that the free end has a greater radius of curvature than the fixed end of the diaphragm or seal leaf. Moreover, in a two-stage seal assembly of the aforementioned type, the rim seal, either diaphragm or leaf, has a free end turned inside out in the direction of the high pressure opening in the seal assembly and as a result the free end of either the diaphragm or the seal leaf has a reduced diameter as compared to that of the fixed portion of the high pressure rim seal.

When a diaphragm or leaf is formed inside out and from a sheet metal shim stock to follow a constant curvature as shown in FIG. 6 of the Bracken Jr. et al patent at reference numeral 58, the free end of the circular leaf, when deflected to an installed height, will be put into compression. This causes waviness or buckling in the seal leaf and resultant excessive leakage. Such a condition can cause unequal pressure drop between the two leaf stages and a low pressure drop across one leaf stage which will not function properly.

Accordingly, an object of the present invention is to improve regenerator seal assemblies having a two-stage seal system therein by the provision of a rim seal at the high pressure opening through the seal assembly with a free end of a seal leaf therein turned inside out to face the high pressure opening in the seal assembly and wherein the high pressure rim seal is comprised of a plurality of straight leaf segments having an acute angular relationship with respect to the ends of straight leaf segments at the cross arm of the seal assembly and substantially obtusely angled mitered joints at junction of the ends of each straight leaf segment of the high pressure rim seal assembly and operative to maintain a neutral stress condition in the free end of each seal leaf segment therein to prevent buckling and excessive leakage from the high pressure opening through the seal assembly and an outer radially located intermediate pressure region of the seal assembly thereby to maintain a substantially even split of pressure drop across a two-stage seal configuration on the cross arm and rim portion of the seal assembly between the high pressure opening and the low pressure opening through the rotary regenerator seal assembly.

Further objects and advantages of the present invention will be apparent from the following description, reference being had to the accompanying drawings wherein a preferred embodiment of the present invention is clearly shown.

Figure 1:
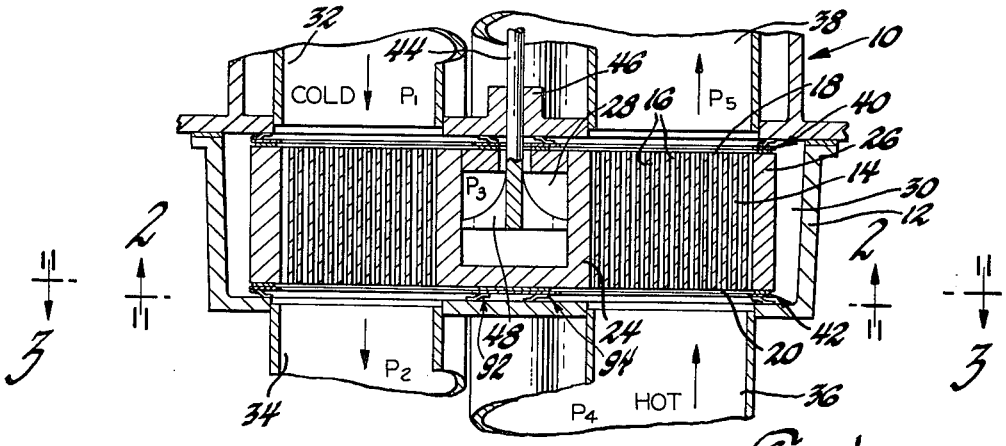
FIG. 1 is a diagrammatic view of a rotary regenerator including the seal assembly of the present invention.

Referring now to the drawings, in FIG. 1, a regenerator assembly 10 is illustrated including a drum shaped housing 12 surrounding an annular matrix or disc 14.

Figure 7:
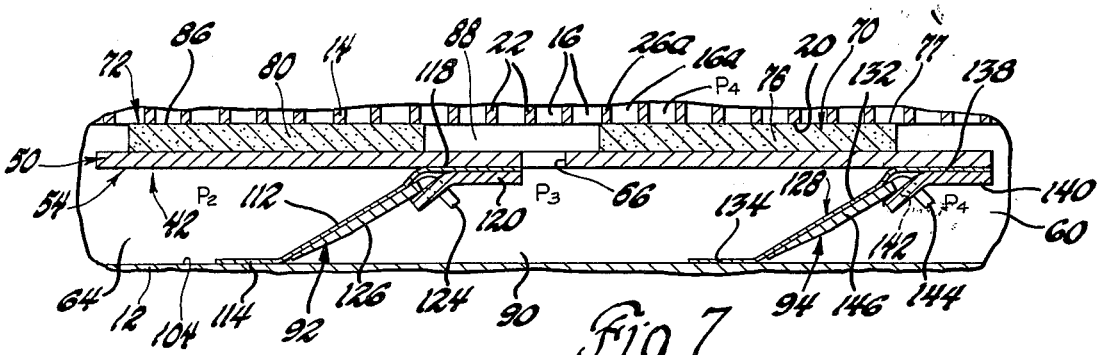
FIG. 7 is a vertical cross-sectional view taken along the line 7—7 of FIG. 3 looking in the direction of the arrows.

The matrix 14 is made of either a corrugated, thin metallic sheet spirally wound upon itself to form a plurality of pores therethrough or, alternatively, is a fired ceramic material formed either by extrusion or winding a corrugated layer of ceramic spirally upon itself to form the pore structure therethrough. In either event, the resultant, annular matrix has a plurality of longitudinal pores or passages 16 formed therethrough from an outboard surface 18 to an inboard surface 20 thereon. As best shown in FIG. 7, each of the passages 16 includes a separating cell wall 22 formed completely across the width of the matrix 14 between each of the outboard and inboard surfaces 18, 20.

In the illustrated arrangement, the matrix 14 is illustrated as including an impervious inner rim 24 and an impervious outer rim 26. It is not essential, however, that such rims be provided in all regenerator assemblies utilizing the present invention.

Figure 2:
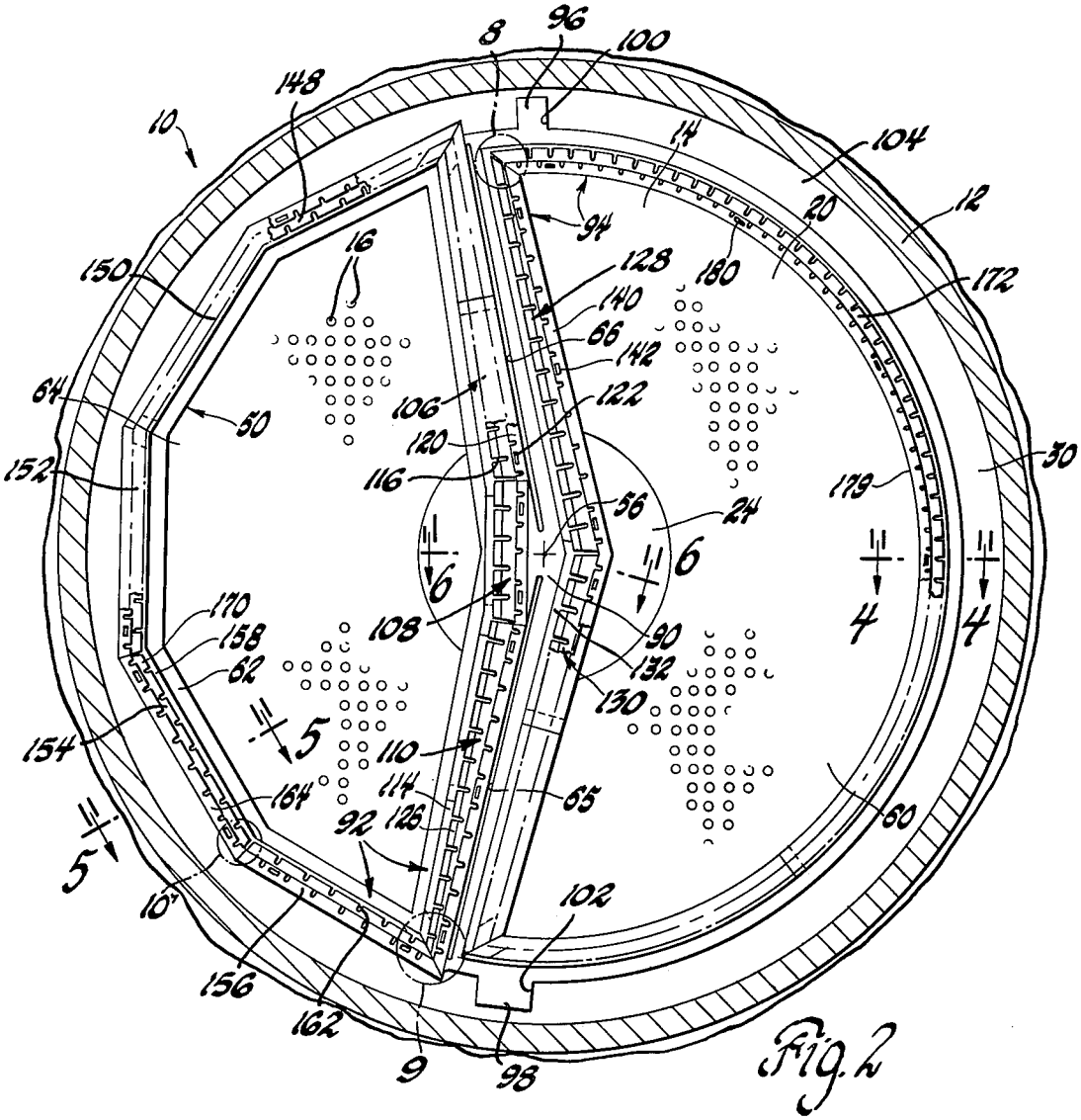
FIG. 2 is an enlarged, horizontal cross-sectional view taken along the line 2—2 of FIG. 1 looking in the direction of the arrows.

A generally cylindrical space 28 is provided centrally of the matrix 14 which communicates with an outer radially located peripheral space 30 located circumferentially around the outer circumference of the outer rim 26 as best shown in FIG. 2. An inlet 32 for cool, high pressure air enters one face of the housing 12 and opposite to it an outlet 34 is included for receiving heated compressed air from the regenerator 10 prior to passage thereof to a combustor section of a gas turbine engine. An inlet 36 receives low pressure, hot exhaust gas from the discharge of a turbine section in the gas turbine engine. These hot exhaust gases leave the inlet 36, pass through the matrix 14 and thence are discharged through an outlet 38. Accordingly, the cold gas stream through the regenerator 10 and the hot gas flow therethrough are in counterflow relationship in the illustrated arrangement, it being understood, however, that such a flow relationship is not essential to practice the present invention.

Also, in the illustrated arrangement the hot gas passage through the inlet 36 and outlet 38 is of a larger area than the cold air passage through the inlet 32 and outlet 34 due to differences in density in the cooled and heated air, but again, such dimensional configurations are merely incidental to the specific form of the invention to be discussed and illustrated herein.

In accordance with the present invention, the outboard surface 18 of the matrix 14 is associated with an improved, two-stage outboard regenerator matrix seal assembly 40 which finds a counterpart inboard seal assembly 42 interposed between the inboard surface 20 and the housing 12 on the opposite side of the matrix 14.

In the illustrated arrangement, the seal assemblies 40, 42 are maintained in a plane generally perpendicular to the axis of rotation of the matrix 14 which is driven by a drive shaft 44 on suitable bearings in a boss 46 on the housing 12 and which shaft 44 is connected to a coupling means in the form of a spider 48 and suitable fastener means (not illustrated) to the inner rim 24 of the matrix 14.

The seal assemblies 40, 42 located between each surface 18, 20 of the matrix 14 and the housing 12 confine the cold and hot gases to a desired longitudinal path through the matrix between the inlets and outlets heretofore described and are configured to minimize leakage between the illustrated counter-flow cold and hot gas flow path through the matrix 14.

Figure 3:
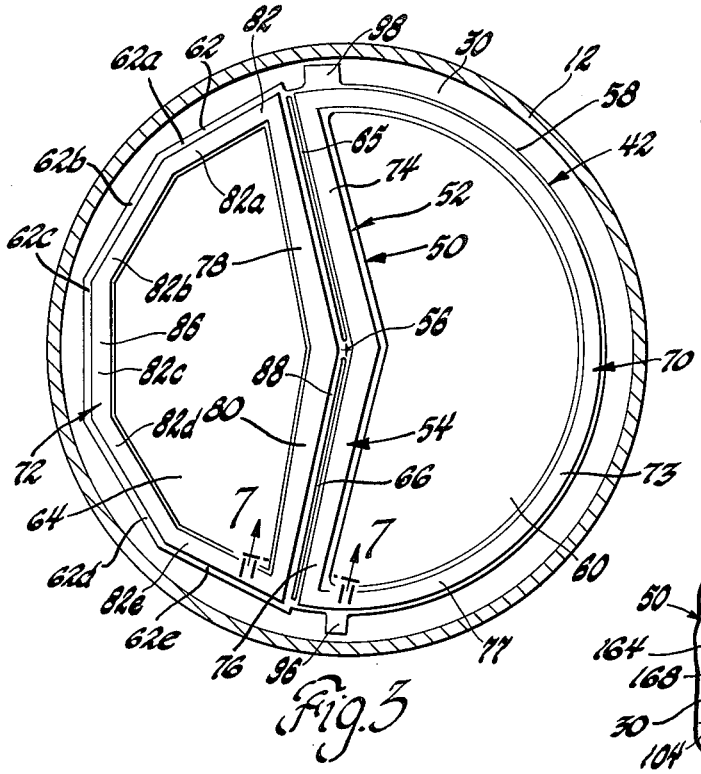
FIG. 3 is a cross-sectional view taken along the line 3—3 of FIG. 1 looking in the direction of the arrows.
Figure 4:
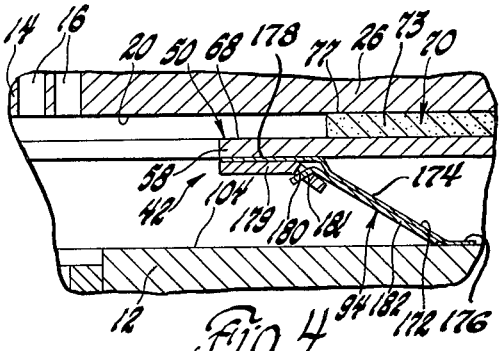
FIG. 4 is an enlarged, vertical sectional view taken along the line 4—4 of FIG. 2 looking in the direction of the arrows.

Referring now more particularly to FIG. 3, the seal assembly 42 specifically is illustrated, with it being understood that the seal assembly 40 has a similar configuration. The seal assembly 42 includes a seal platform 50 having a pair of radial arms 52, 54 directed from the center of rotation 56 of the matrix 14 to be joined to ends of a semi-circular rim 58 of the platform 50. Arms 52, 54 and rim 58 together define the outer periphery of a low pressure opening 60 through the seal assembly 42. Likewise, the radial arms 52, 54 are joined to a high pressure rim 62 made up of a plurality of straight segments 62*a*, 62*b*, 62*c*, 62*d* and 62*e* that are formed along chord lines of a imaginary circle corresponding to that of the circular form of rim 58. The high pressure rim 62 forms the outer boundary of a high pressure opening 64 through the seal assembly 42 which is also in part formed by the radial arms 52, 54 as best shown in FIG. 3.

The arm 52 includes an elongated, pressure equalization port 65 extending from the junction with the rim 62 and rim 58 to the vicinity of the axis of rotation 56. The arm 54 includes an elongated, pressure equalization port 66 formed therethrough from the intersection of the arm 54 with the rim 62 and rim 58 to a location in the vicinity of axis of rotation 56 as shown in FIG. 3. The platform 50 includes an inner planar surface 68 on which is supported a pair of face seal blocks 70, 72. The face seal block 70 includes a circular rim portion 73 and a pair of radial arm portions 74, 76 supported respectively on the rim 58 and the arms 52, 54 as shown in FIG. 3. Together, portions 73, 74 and 76 define a matrix engaging wear surface 77 that is formed continuously around the low pressure opening 60 for sealing the parametric regions thereof at the inboard surface 20 of the matrix 14.

Likewise, the face seal block 72 includes a pair of radial arms 78, 80 joined to a straight, segmented outer seal block segment 82 made up of a plurality of straight line arm segments 82*a* through 82*e* which are joined together to form a continuous perimeter around the high pressure opening 64 through the matrix 14. The various arm segments of the seal block 72 include a wear surface 86 thereon that engages the inboard surface 20 of the matrix 14 for sealing thereagainst around the opening 64.

In the illustrated arrangement, the wear surface 77 and the wear surface 86 are flat within 0.002 inches when the surface is loaded to 1 p.s.i.

The radial arms 74, 76 are located in spaced parallelism with the radial arms 78, 80 to define an intermediate pressure space 88 between the face seal block 70, 72. The space 88 is communicated by the pressure equalization slot 64, 66 with an intermediate pressure region 90 formed by seal leaf assemblies 92, 94.

The seal leaf assemblies 92, 94 are supported by the seal platform 50 and are in engagement with a planar surface of the housing 12 to maintain the face seal blocks 70, 72 uniformly biased against the inboard surface 20 of the matrix 14 as it is rotated with respect thereto.

More particularly, the seal platform 50 is interlocked with respect to the housing 12 by a pair of radially outwardly directed tabs 96, 98 thereon which are interlockingly connected within slots 100, 102 within the housing 12 at substantially diametrically located points on the housing 12 radially outwardly of an inboard backing surface 104 thereon.

In accordance with the present invention the seal assembly 92 includes three straight segments 106, 108, 110, each including a seal leaf 112 of thin shim stock with a free end 114 thereon located in juxtaposed engagement with the backing surface 104 to define a sealed interface therebetween. The free end of the structural leaf or abutment plate 126 includes a plurality of grooves 116 therein that permit free torsional flexure of leaf 126 with respect to the backing plate 104 to assure a uniform sealing engagement therebetween. Each seal leaf 112 further includes a flange 118 thereon which is interposed between the seal platform 50 and a hinge plate 120 tack welded along with flange 118 to platform 50. Plate 120 includes a plurality of spaced openings 122 that receive bent tabs 124 on the upper edge of an abutment plate 126 that backs the seal leaf 112 along its length to support it when the seal assembly 92 is in a deflected, assembled position between the housing 12 and the inboard surface 20 of the matrix 14.

The seal leaf 112 serves the dual function of biasing the wear surface 86 with respect to the inboard base 20 of the matrix 14 and the further purpose of defining a seal between the opening 64, constituting a high pressure region $P_2$, from an intermediate pressure region $P_3$ formed within the intermediate pressure region 90.

Likewise, the seal leaf assembly 94 includes a pair of straight segments 128, 130, each including a flexible seal leaf 132 formed of thin shim stock. Each of the structural leafs or abutment plates 146 includes a plurality of spaced apart grooves therein to permit free torsional flexure of the structural leafs 146 with respect to the backing plate 104 so that the free end 134 of the sealing leaf will be held in close, juxtaposed relationship therewith to form a sealed interface therebetween. Each seal leaf 132 further includes a fixed flange 138 thereon interposed between the seal platform 50 and a hinge plate 140 that includes openings 142 therein receiving bent tabs 144 at spaced apart points on the upper edge of abutment plate 146. Plate or structural leaf 146 backs the seal leaf 132 as did the previously described abutment surface 126 with respect to the leaf seal 112. Flange 138 and hinge plate 140 are connected to seal platform by tack welds.

The straight seal segments 128, 130 seal between the intermediate pressure region 90 with the pressure $P_3$ therein and the low pressure hot exhaust gas opening 60 with a pressure $P_4$ therein. It will be noted that each of the seal leafs 112, 132 is faced in the direction of the greater pressure so as to maintain a maximized seal pressure at the interface between the free ends 114, 134 and backing plate 104.

Figure 5:
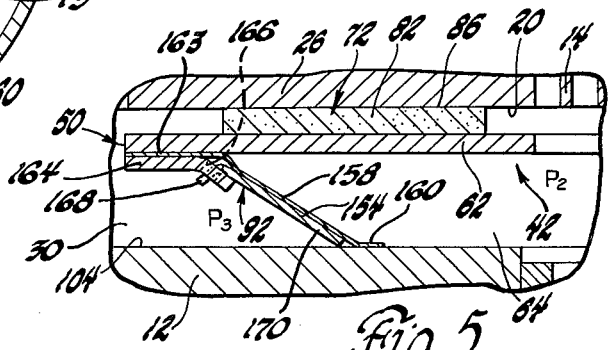
FIG. 5 is an enlarged, vertical sectional view taken along the line 5—5 of FIG. 2 looking in the direction of the arrows.
Figure 6:
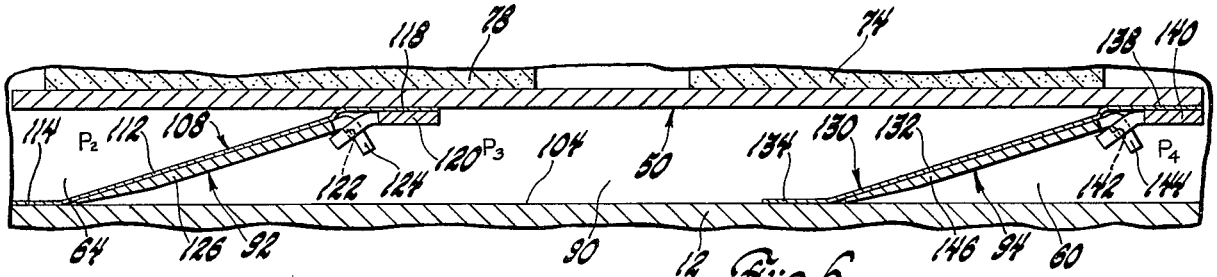
FIG. 6 is an enlarged cross-sectional view taken along the line 6—6 of FIG. 2 looking in the direction of the arrows.

The high pressure, cold air opening 64 also is sealed by a plurality of straight rim seal segments 148, 150, 152, 154, and 156. Each of the segments are like segment 154 which is shown in FIG. 5 as including a seal leaf 158 of thin shim stock with a free end 160. The structural leaf 154 includes a free end with a plurality of spaced grooves 162 formed therein to be maintained in sealing engagement with the backing plate 104. It further includes a fixed flange 163 thereon interposed between the seal platform 50 and a hinge plate 164 thereon with an opening 166 that receives a bent tab 168 on an abutment plate 170 that backs the leaf spring 158. In order to maximize the sealing configuration of the free end 160 of the seal leaf 158 with respect to the backing plate 104, it is turned inside out with respect to the high pressure cold air opening 64 so that when it is deflected to an installed height, which is reduced from a normally preformed height relationship between the fixed flange 163 and the free edge 160, the seal leaf 158 will be maintained neutrally stressed, because of its straight line configuration. Accordingly, the seal interface between the free end 160 and the backing plate 104 will be maintained without waviness or wrinkles to maintain a positive rim seal between the cold air opening 64 and the outer peripheral space 30 maintained at pressure $P_2$ and $P_3$, respectively.

The seal leaf assembly 94 also includes a rim seal configuration which also has a rim seal leaf faced in the direction of the higher pressure region of the regenerator so as to minimize leakage between higher and lower pressures. More particularly, the seal assembly 94 includes a circular rim seal 172 with a continuously circumferentially formed seal leaf 174 that has a continuous semicircular free end 176 thereon located in sealing engagement with the backing plate 104 and including a generally semicircularly configured fixed flange 178.

The fixed flange 178 is secured between the platform 50 and a hinge plate 179 that includes a plurality of spaced slots 180 therein to receive bent tabs 181 on an abutment plate 182 serving to back the seal leaf spring 174. The seal leaf 174 is faced in a higher pressure direction so as to cause the free end 176 thereon to be held by the higher pressure in sealing engagement with the backing plate 104. The circular rim seal 172, however, has a greater radius at the free end 176 as compared to the radius of the fixed flange 178. When seal 172 is deflected into its installed position it will be in tension so as to positively assure removal of any buckling or waviness from the free end 176 at its engagement with the backing plate 104 thereby to assure a tight seal therebetween.

The combination of the straight, inwardly turned free ends 160 on the straight rim seal segments 148 through 156 and the outwardly directed free end 176 on the circular rim seal 172 together define a highly effective rim seal configuration between the intermediate pressure regions defined by the spaces 30, 48 and the flow openings 60 and 64 through the regenerator.

The illustrated straight line segment at both the high pressure rim seal and the joints between the cross arm seals and the low pressure rim seal have miter joints to permit accurate location of the straight line segments with respect to one another as well as with respect to the ends of the circular form low pressure rim seal.

Figure 8:
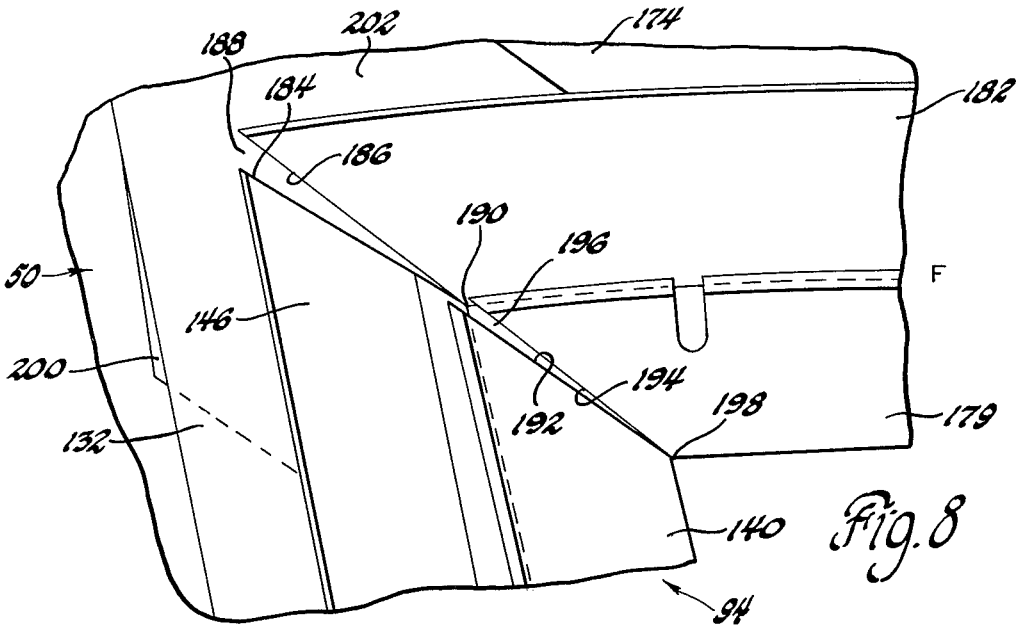
FIG. 8 is an enlarged, fragmentary bottom elevational view of a mitered joint in the seal assembly of FIG. 2 at region 8 therein.

More particularly, in FIG. 8, a miter joint at the outwardly directed seal leaf segment at the joint in region 8 in FIG. 2 is illustrated. The leaf seals 132 and 174 are overlapped at corner edges thereof. The abutment plates 146 and 182 have end edges 184, 186 respectively, that are formed at an angle to define a gap 188 therebetween and an apex gap at point 190 in the order of 0.005 inches to assure free hinging movement of the abutment plates 146, 182 with respect to the hinge plates 140, 179. Each of the hinge plates 140, 179 includes mitered end edges 192, 194, respectively, also formed to define a gap 196 therebetween and a point contact at an apex region 198. In the illustration of FIG. 8, the leaf segment 174 is shown as having a corner 200 formed thereon that is overlapped by the corner 202 on the seal leaf 132 to define an overlapping junction of the seal leafs at the miter joint. The aforesaid miter joint configuration defines a precise fit of end components at the rim seal 172 and the straight segment 128 of the cross-arm portion of seal assembly 94. It represents a precisely located corner transition between the nonstressed straight segments of the cross arm seal and the outwardly facing seal leaf component of the rim seal 172 that is placed under tension when the seal assembly 94 is placed in a deflected, assembled relationship between the backing plate 104 and the inboard face 20 of the matrix 14.

Figure 9:
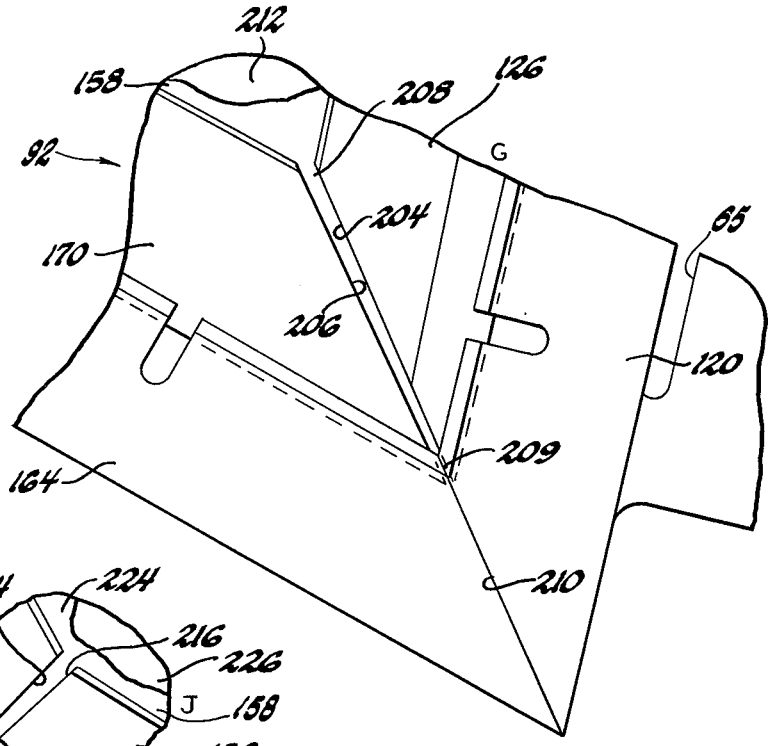
FIG. 9 is an enlarged fragmentary bottom elevational view of a second mitered joint at region 9 in the seal assembly of FIG. 2.

An inside-out turned joint in region 9 of the seal assembly 92 in FIG. 2 is illustrated in FIG. 9. The abutment plate 126 of straight segment 110 has a mitered end 204 located in spaced relationship to a mitered end 206 of the abutment plate 170 of the straight segment 156 of the high pressure rim seal. An angular gap 208 is formed therebetween and includes an apex region 209. The hinge plates 120, 164 are joined along a mitered joint line 210. The gap at 209 is maintained at a close clearance of 0.005 to 0.000 inches to assure hinge movement of the abutment plates 126, 170 with respect to the hinge plates 120, 164. In the illustrated arrangement, a corner segment 212 of the seal leaf 158 is in overlapping relationship with the leaf segment of the circular rim seal assembly 172 to assure positive sealing at this corner.

Both the joints in FIG. 8 and FIG. 9 are arranged so that the component parts of the joint seal segment are arranged in acute angular relationship with respect to one another.

Figure 10:
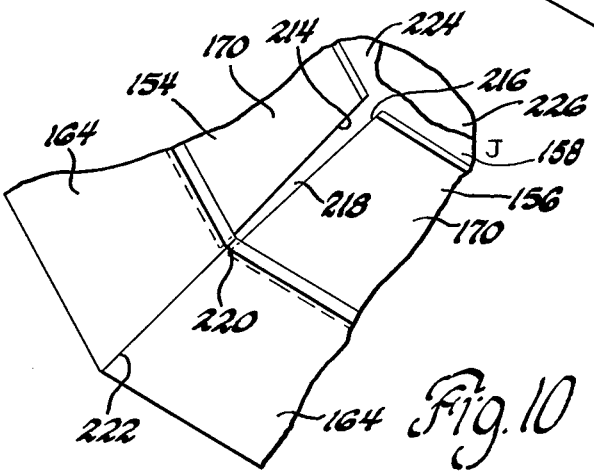
FIG. 10 is an enlarged fragmentary bottom elevational view of a third mitered joint detail at region 10' in the seal assembly of FIG. 2.

The straight line seal segments 106–110, 128 and 130 in the cross arm portions of seal assemblies 92 and 94 and the straight line segments 148 through 156 at the high pressure rim seal of the assembly are formed at an obtuse angular relationship as shown in FIG. 10 which represents the joint at region 10 in FIG. 2. In this arrangement, the abutment plate 170 of each of the straight seal segments 154, 156, respectively, is formed to have end edges 214, 216, respectively, to form a gap 218 between the abutment plate 170 with an apex region having a control gap in the order of 0.005 to 0.000 inches at apex 220 to assure free hinge movement of the abutment plates 170 with respect to the outwardly located hinge plates 164. The hinge plates 164 have end edges joined along their length at a miter joint 222. Overlapped segments 224, 226 on each of the leaf seals 158 seal the abutment joint to prevent leakage thereacross.

The present invention produces a substantially equal pressure loss across the straight cross arm seal leaf segments 106 through 110 and 128, 130 and seal blocks 74, 76 and 78, 80. Thus, as viewed in FIG. 7, each of the flow passages or pores 16 through the matrix 14 will have a reduced pressure differential across its cell wall 22. For example, the passage **16*a* in FIG. 7 will have a pressure in the order of $P_4$ on one side of its wall 26*a* and a pressure in the order of $P_3$ on the opposite side of wall 26*a*** rather than a pressure differential represented by the difference between $P_2$ and $P_4$. Accordingly, wall stress in the matrix is reduced since a substantially 50 percent pressure reduction between the high pressure and low pressure region in the regenerator can be maintained by the two-stage seal configuration described above.

The operation of the regenerator 10 more specifically includes directing pressurized cold air through the inlet 32 which represents the highest pressure in the system shown as $P_1$, a pressure which in one representative system is in the order of 50 p.s.i. There is a slight pressure loss due to friction as air flows through the matrix so that the pressure $P_2$ in the high pressure outlet 34 is slightly below $P_1$ by perhaps 1% or 2%. In the illustrated arrangement, the pressure of hot gas entering the matrix through the inlet 36 is identified as $P_4$ which is in the order of something like one-fourth of pressure $P_1$ and only slightly above atmospheric pressure. As in the case of cold air flow through the matrix 14 hot air flow therethrough results in a slight pressure drop so that the pressure at the outlet 38, designated $P_5$ is slightly less than $P_4$ and usually is substantially at atmospheric pressure. In the illustrated arrangement there is also an intermediate pressure $P_3$ which occurs in the cylindrical space 28 and the peripheral space 30. The intermediate pressure $P_3$ is usually less than $P_2$ and greater than $P_4$ and is a pressure derived from the ports 65, 66 in the seal platform arms 52, 54. The pressure is delivered through seal interconnecting conduits to the space 28 within the inner rim of the matrix and the space 30 extending around and outside of the matrix within the housing 10. The intermediate pressure $P_3$ as previously mentioned is also in the intermediate pressure region 90 between the cross arm portion of the seal assemblies 92, 94. Thus, the pressure differential across the rim seals 72 for the cold air path is either $P_1$ minus $P_3$ or $P_2$ minus $P_3$, these quantities being substantially the same. The pressure differential across the low pressure rim seals 70 is either $P_3$ minus $P_4$ or $P_3$ minus $P_5$. Again, these pressures are essentially the same.

Thus, all the rim seals are subject to the difference between a higher pressure and an intermediate pressure or to the difference between the intermediate pressure and a low pressure and none of the rim seals have a full pressure drop from high pressure to low pressure thereacross. This enables the wear surface of each of the seal blocks to be maintained in sealing engagement with the matrix without excessive wear pressure therebetween. Since only an intermediate pressure differential must be sealed at the rim, seal leakage can be maintained without excessive wear pressure between the seal blocks and the matrix.

In the illustrated arrangement, the intermediate pressure $P_3$ is derived by virtue of the configuration of the ports 65, 66 in the seal platform 50. The port 65 is located in the fixed cross arm 52 which the matrix 14 traverses in rotating from the high pressure opening 64 to the low pressure opening 60 and the port 66 is located in the other cross arm 54 where the matrix 14 rotates from the low pressure opening 60 to the high pressure opening 64. The ports 65, 66 communicate the spaces between the face seal blocks at arms 78, 80 and 74, 76 and the straight leaf seal segment 106 through 110 and 128, 130. These yieldable walls define an equalizing conduit of substantial cross-sectional area to produce free flow of air trapped in the matrix from ports 65, 66 through the equalized pressure region 90 to transfer any leakage of pressurized air from the passages 16 as the matrix 14 moves from openings 64 to openings 60 and to direct pressure back into passges 16 when they move from the low pressure openings 60 to the high pressure opening 64.

The structure thus provides a quite substantial cross-sectional area for pressure equalization, with the relation of the volume of flow due to filling of the matrix at one arm from gas which flows from the matrix to the other arm. The arrangement also accommodates any leakage at the rim seal. Thus, a substantially equal intermediate pressure exists at both the port 65 and the port 66.

While the concept of an equalized intermediate pressure region is fully set forth in U.S. Pat. No. 3,368,611 to Bracken Jr., et al, in practice, it is observed that where circular rim seals of the type set forth in the Bracken arrangement are utilized, that rim seal leakage becomes excessive and thereby reduces the equalization of pressure between the high and low pressure sides of the regenerator matrix so that the maximum pressure drop across any given core cell wall can exceed one-half of the pressure found in a single stage cell.

Furthermore, the present invention eliminates excessive rim seal leakage so that the pressure drop between two crossarm leaf stages will be maintained split between the two leaf stages.

While the embodiments of the present invention, as herein disclosed, constitute a preferred form, it is to be understood that other forms might be adopted.

The embodiments of the invention in which an exclusive property or privilege is claimed are defined as follows:

1. A two stage regenerator matrix disc seal assembly comprising a support platform with opposite faces and having a rim and a cross arm connected at opposite ends thereof to said rim to form a high pressure flow path and a low pressure flow path, first and second seal wear blocks supported on one face of said platform, said first and second seal wear blocks being spaced at said cross arm to form a mid-pressure zone between the high and low pressure flow paths, means forming a passage through said cross arm to communicate the mid-pressure zone with the other face of said platform, a low pressure seal assembly on the other face surrounding said low pressure flow path including a semicircular low pressure rim seal leaf having a fixed end connected to said platform and including a free end directed radially outwardly of said rim, said free end having a greater radius than the radius of the fixed end of said seal leaf and deflectable to an installed height wherein the free end of the low pressure seal leaf is maintained in tension to prevent waviness throughout the circumferential extent of said semicircular low pressure seal leaf, said low pressure seal assembly further including a straight low pressure stage seal leaf connected to said other face of said cross arm to seal one side of said mid-pressure zone, a high pressure seal assembly surrounding said high pressure flow path including a high pressure straight seal leaf supported on said cross arm in spaced relationship to said low pressure seal thereon and including a free end portion directed toward said high pressure flow path, said high pressure seal assembly further including a plurality of straight rim seal leaf segments formed as chords on said platform and including free ends directed toward said high pressure flow path, means for suporting said last mentioned straight leaf segments on said platform to seal the outer peripheral portion of the high pressure flow path, said straight rim seal leaf segments of said high pressure rim seal and said low pressure and high pressure cross arm seal leafs being neutrally stressed upon deflection to an installed height to prevent waviness in said seal where the free end of a seal leaf is of a smaller radius than the fixed end of the seal leaf.

2. A two-stage regenerator matrix disc seal assembly comprising a support platform with opposite faces and having a rim and a cross arm connected at opposite ends thereof to said rim to form a high pressure flow path and a low pressure flow path, first and second seal wear blocks supported on one face of said platform, said first and second seal wear blocks being spaced at said cross arm to form a mid-pressure zone between the high and low pressure flow paths, means forming a passage through said cross arm to communicate the mid pressure zone with the other face of said platform, a low pressure seal assembly on the other face surrounding said low pressure flow path including a semi-circular low pressure rim seal leaf having a fixed end connected to said platform and including a free end directed radially outwardly of said rim, said free end having a greater radius than the radius of the fixed end of said seal leaf and deflectable to an installed height wherein the free end of the low pressure seal leaf is maintained in tension to prevent waviness throughout the circumferential extent of said semicircular low pressure seal leaf, said low pressure seal assembly further including a straight low pressure stage seal leaf connected to said other face of said cross arm to seal one side of said mid-pressure zone, a high pressure seal assembly surrounding said high pressure flow path including a high pressure straight seal leaf supported on said cross arm in spaced relationship to said low pressure seal thereon and including a free end portion directed toward said high pressure flow path, said high pressure seal assembly further including a plurality of straight rim seal leaf segments formed as chords on the circular rim of said platform and including free ends directed toward said high pressure flow path, each of said leaf segments having overlapping portions thereon, and backing plates forming an obtusely angled, mitered joint to support said overlapping portions, means for supporting said last mentioned straight leaf segments on said platform to seal the outer peripheral portion of the high pressure flow path, said straight rim seal leaf segments of said high pressure rim seal and said low pressure and high pressure cross arm seal leafs being neutrally stressed upon deflection to an installed height to prevent waviness in said seal where the free end of a seal leaf is of a smaller radius than the fixed end of the seal leaf.

3. In a regenerator assembly of the type having a rotating matrix with axial passages therethrough separated by cell walls, the improvement comprising means including a support platform with opposite faces and having a rim and a cross arm connected at opposite ends thereof to said rim to form a high pressure space and a low pressure space, a seal wear block supported on one face of said platform engageable with said matrix to separate said high pressure space from said low pressure space, a seal assembly surrounding said high pressure space including a high pressure straight seal leaf supported on said cross arm, said seal leaf including a free end portion directed toward said high pressure space, said high pressure seal assembly further including a plurality of straight rim seal leaf segments formed as chords on the rim of said platform and including fixed ends and free ends directed toward said high pressure space, said lastmentioned free ends having a smaller radius than said fixed ends, means for supporting said rim seal leaf segments on said platform to seal the outer peripheral portion of the high pressure flow path, said straight rim seal leaf segments of said high pressure rim seal being neutrally stressed upon deflection to an installed height to prevent waviness where its free end of a seal leaf is of a smaller radius than its fixed end.

* * * * *